United States Patent [19]

Hjelle

[11] Patent Number: 5,005,679

[45] Date of Patent: Apr. 9, 1991

[54] TOTE BAGS EQUIPPED WITH A COOLING CHAMBER

[76] Inventor: Kurt R. Hjelle, 315 S. East Ave., Viroqua, Wis. 54665

[21] Appl. No.: 475,679

[22] Filed: Feb. 6, 1990

[51] Int. Cl.[5] ..... A45C 3/00; A45C 11/20; A45C 13/02

[52] U.S. Cl. ..... 190/110; 190/108; 190/111; 190/125; 150/106; 150/113; 206/522; 206/545; 383/110

[58] Field of Search ..... 190/1, 108, 111, 125, 190/103, 110, 100; 150/106, 107, 113, 110; 383/3, 2, 110, 18; 206/522, 541, 545; 224/151, 153, 211, 215, 274

[56] References Cited

U.S. PATENT DOCUMENTS

| | | | |
|---|---|---|---|
| Re. 25,826 | 8/1965 | Ward | 190/108 |
| 2,575,191 | 11/1951 | Seipp | 383/110 X |
| 2,759,617 | 8/1956 | Gauthier | 383/110 X |
| 2,825,208 | 3/1958 | Anderson | 206/541 X |
| 3,085,612 | 4/1963 | Gobel | 383/110 X |
| 3,142,599 | 7/1964 | Chavannes | 206/522 X |
| 4,298,103 | 11/1981 | De Fries | 383/110 X |
| 4,334,601 | 6/1982 | Davis | 190/111 X |
| 4,429,793 | 2/1984 | Ehmann | 206/545 X |
| 4,506,769 | 3/1985 | Franco et al. | 190/108 |
| 4,569,082 | 2/1986 | Ainsworth et al. | 383/110 X |
| 4,573,202 | 2/1986 | Lee | 190/125 X |
| 4,673,117 | 6/1987 | Calton | 224/153 X |
| 4,679,242 | 7/1987 | Brockhaus | 383/110 X |
| 4,767,039 | 8/1988 | Jacober | 224/151 |
| 4,781,277 | 11/1988 | Lim | 150/106 X |
| 4,884,731 | 12/1989 | Silbey | 383/2 X |
| 4,921,151 | 5/1990 | Duvall | 190/125 X |
| 4,929,094 | 5/1990 | Becker | 383/110 X |

FOREIGN PATENT DOCUMENTS

| | | | |
|---|---|---|---|
| 85534 | 8/1983 | European Pat. Off. | 383/110 |
| 1258696 | 3/1961 | France | 150/107 |
| 2573635 | 5/1986 | France | 190/103 |
| 8002910 | 11/1980 | Netherlands | 206/522 |
| 2201394 | 9/1988 | United Kingdom | 383/3 |

*Primary Examiner*—Sue A. Weaver

*Attorney, Agent, or Firm*—M. Paul Hendrickson

[57] ABSTRACT

The present invention provides a tote bag equipped with a flexible, durable and lightweight cooling chamber. The cooling chamber is comprised of a cooling compartment secured to an uninsulated portion of a tote bag, a cooling chamber housed within the compartment, a flexible external housing member which externally circumscribes the chamber and forms a protective covering, a flexible insulative liner internally disposed within the housing member and enveloping the cooling chamber and a cooler compartment accessing port for access to the cooling chamber. The cooling compartment may also be equipped with means for removing the insulative liner from the housing member and also for detachably removing the housing member from the uninsulated portions of the tote bag. Flexible insulative liners containing a multiplicity of closed gas cells uniformily distributed throughout a flexible plastic sheet or film such as bubble packs used in the packaging industry are particularly well suited for the insulated tote bag of this invention.

19 Claims, 3 Drawing Sheets

TOTE BAGS EQUIPPED WITH A COOLING CHAMBER

FIELD OF THE INVENTION

The present invention relates to multi-compartment traveling bags equipped with a cooling chamber and more particularly tote bags fitted with a cooling chamber.

BACKGROUND OF THE INVENTION

Tote bags are extensively used by travelers and athletes. The design, construction and versatility of tote bags are especially well suited for use by participants in sporting affairs. The flexible, light-weight design and construction allows sporting participants to partially or completely fill the tote bag with attire, equipment and other sundry articles. Participants such as swimmers, tennis, soccer, football, baseball, basketball, players, etc. frequently use tote bags to carry their sporting attire to the sporting event. Upon completing the sporting activity, the participant may change into more appropriate street attire. Consequently, tote bags often serve as luggage carriers for sweat laden, soiled and dirty sporting attire which, in turn, leads to a generally unhealthful luggage environment.

Participants in sporting events will often expend excessive energy and water which needs to be replenished. Transportable coolers often serve as a common water or liquid refreshment source for sporting participants at many publicly or privately funded sporting functions. Most individual or unfunded sporting events, however, necessitate that the individual participant make available his or her own refreshment beverages. Toting a personal cooler is frequently impractical. It would be particularly advantageous if there existed a satisfactory tote bag which would serve both as a cooler and a luggage carrier.

The patent literature has not devoted its attention towards the creation and development of a tote bag which would effectively serve the dual purpose of a luggage carrier and a liquid refreshment cooler. U.S. Pat. No. 4,673,117 by J. D. Calton discloses a back-pack cooler which primarily serves as a beverage cooler. The Calton back-pack cooler is constructed of a rigid foam insulative core equipped with a rigid, tight fitting removable insulative lid for cooler access with the core being internally lined with a high density plastic, and jacketed on the outside with a cloth sheath. The Calton cooler primarily serves to back-pack beverages, but may also be equipped with a small uninsulated pouch section. Calton teaches that the cloth jacket and rigid insulative foam core combination are an essential embodiment of the back-pack cooler. The rigid insulative foam core disclosed by Calton consists of conventional foamed polystyrenes. Foamed polystyrenes are inherently fragile, and will readily fracture or break upon impact unless adequately protected. Fracturing or breaking of the insulative core does not appear to present a problem with the Calton back-pack cooler, especially since the back-packing positioning inherently protects the back-pack cooler from damage.

Unfortunately, the Calton back-pack technology is inapplicable to tote bag adaptation. Tote bags inherently encounter considerably more destructive abuses than a back-pack. Tote bags are often tossed or jarred against hard objects, biased into baggage carriers or lockers, stacked or piled, stowed in a partially or fully collapsed form, etc., all of which can readily fracture or break the fragile foamed polystyrene insulator. Such protective sheathing or coating of polystyrene foams to militate against foam breakage would not be suitable for tote bag adaptation only because of the excessive weight and bulk but also because such a rigid foam construction would also destroy the prerequisitial flexible and collapsible attributes of a tote bag.

In another patent (U.S. Pat. No. 4,429,793 by E. G. Ehmann), there is disclosed a pocket sized diabetic traveling case which is equipped to carry a refrigerated ampul of insulin. The pocket sized carrying case is similar to Calton by including an outer cover, an inner cover made of a water-resistant plastic and rigid thermal insulative material such as styrofoam (i.e. expanded cellular polystyrene) sandwiched between the external and inner covers.

SUMMARY OF THE INVENTION

Pursuant to the present invention there is provided a tote bag equipped with a flexible cooling compartment. The physical embodiments of the cooling compartment in combination with the uninsulated luggage section affords a tote bag combination which maintains its structural integrity when exposed to the vigorous abuses inherently attendant to tote bag usage. In general, the tote bag includes an uninsulated section to which there is attached a cooling section comprised of a flexible housing member, a flexible insulative liner housed within said member and a cooling chamber internally disposed within said liner for the toting of cooled articles therewithin. Certain materials normally not recognized as suitably adapted for use in portable cooling devices, such as polymeric sheets or films with individually encased gas cells externally protruding above the sheet or film surface, have been unexpectedly discovered to contribute to lower cooling temperatures when used as an insulative liner herein. The physical embodiments of the cooling compartment are designed so as to create and maintain a sanitary environment, notwithstanding conditions which are normally conducive to microbial contamination, malodorous and other unhealthful or socially objectionable conditions.

DETAILED DESCRIPTION AND PREFERRED EMBODIMENTS OF THE INVENTION

With reference to the accompanying drawings, there is provided pursuant to the present invention a flexible tote bag (generally designated as 1) adapted for the dual use in the toting of luggage and thermally cooled articles toted therewithin.

Figure 1:
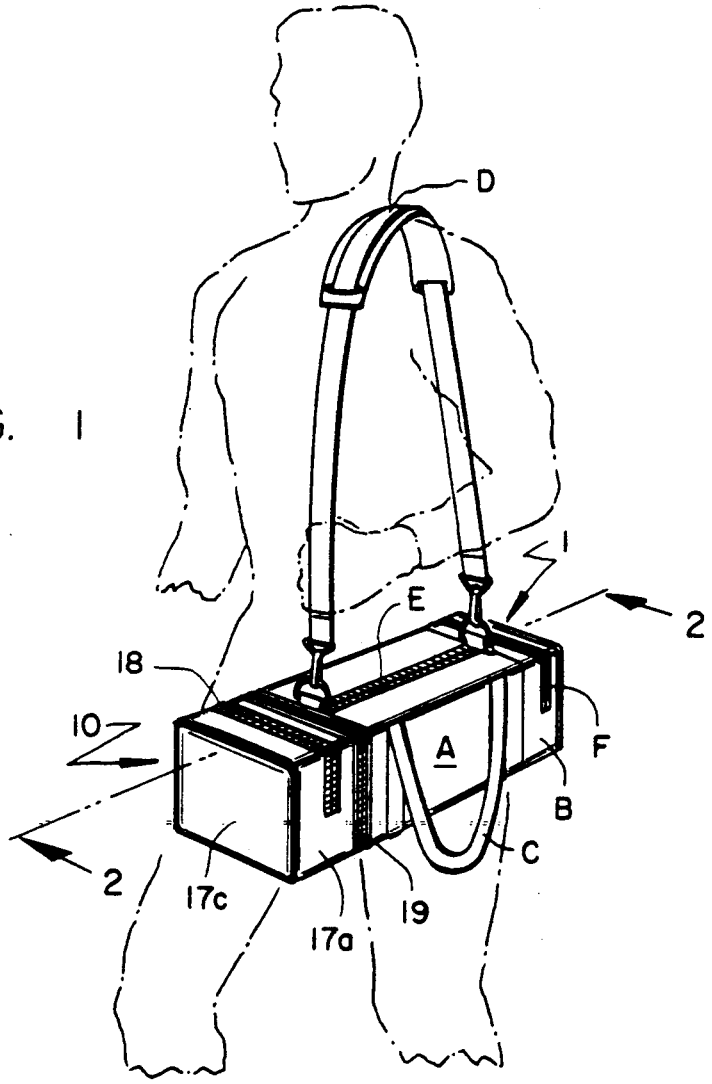
FIG. 1 depicts an external view of a tote bag equipped with a cooling compartment.

The tote bag as illustrated in FIG. 1 includes many of the features of conventional tote bags such as a main luggage compartment A fitted with a zippered accessing port E, a side compartment B fitted with a side compartment zipper F for accessing thereto, hand carrying handles (designated as C), and an adjustable and detachable shoulder strap D slung over the shoulder of a toter. The tote bag of this invention departs from conventional tote bags in that it includes as part of its structure at least one flexible cooling compartment (generally designated as 10) for the storage and toting of cooled articles (not shown) therewithin secured onto at least one uninsulated section (shown as attached to A of the tote bag). Referring more particularly to the particular embodiments of the invention as shown by the cross-sectional view of FIG. 2, the cooling compartment 10 includes: a cooling chamber (generally referenced as 11 in FIG. 2 and other Figures) housed within cooling compartment 10, a flexible, external housing member (generally referenced as 12) externally circumscribing said chamber 11 and forming a flexible and protective covering therefore, a flexible insulative liner (generally designated as 13) internally disposed within said member and enveloping said cooling chamber 11 and a cooler compartment accessing port (generally referenced as 14) which permits for the emplacement and removal of articles from the cooling compartment chamber 11. The flexible tote bag of this invention in combination with its flexible insulated compartment is adapted to effectively withstand the destructive forces and abuses to which a tote bag typically encounters during its normal use. The flexible insulative compartment 10 through its design and construction in cooperative association with the uninsulated sections (particularly its adjacent uninsulated section as described in greater detail hereinafter) forms a highly durable and functional tote bag which may be effectively used for the dual purpose of toting luggage and cooling articles.

The cooling compartment 10 may be fabricated and integrated into the supportive structure of a conventional tote bag in a variety of ways. For example, the cooling compartment 10 may be fabricated by seaming or joining together by conventional seamster techniques an external housing member 12 onto the tote bag from pre-cut fabric or other suitable flexible materials so as to form a suitable housing member 12 to house and protect the flexible insulative liner 13, cooling chamber 11, as well as cooled articles therwithin from damage.

Figure 2:
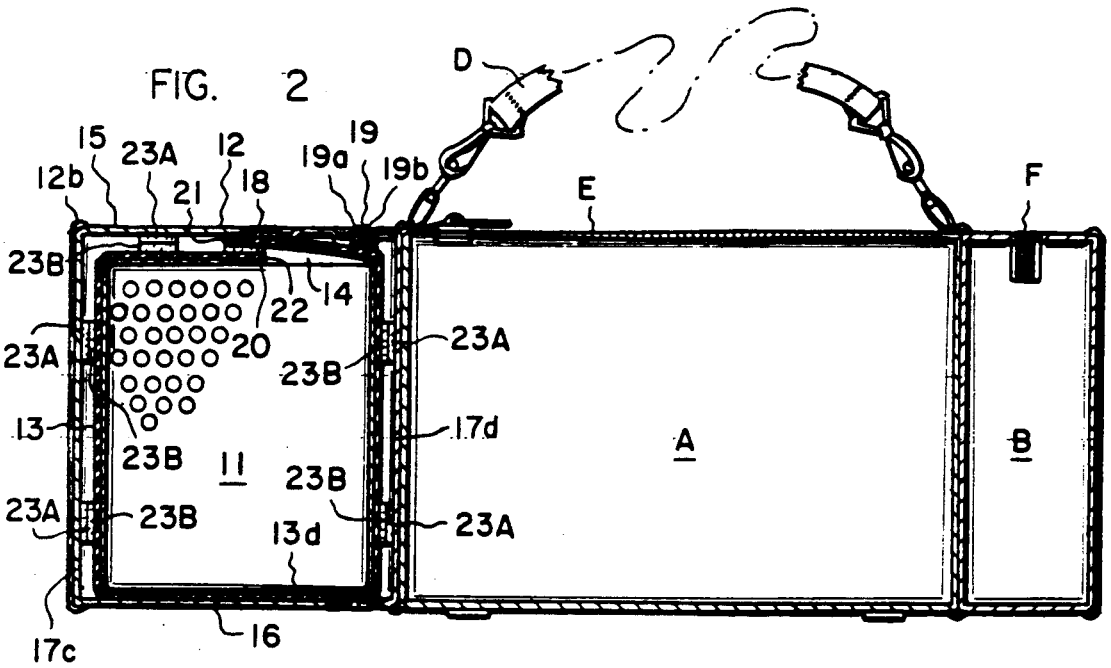
FIG. 2 is a cross-sectional view of the tote bag taken along line 2—2 of FIG. 1.
Figure 6:
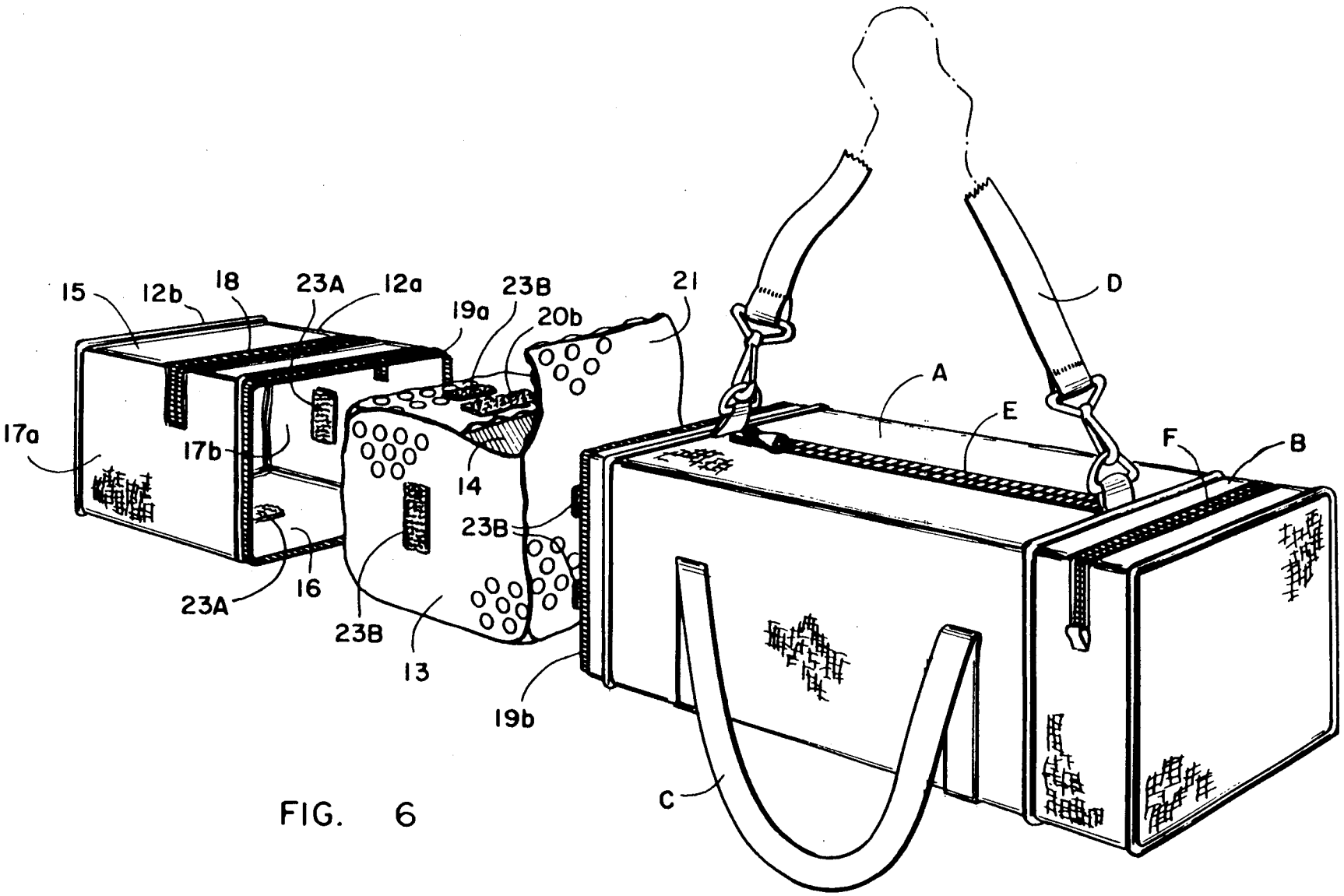
FIG. 6 is an exploded view depicting in greater detail various components of the tote bag.

With particular reference to the cooling compartment 10 embodiments depicted in greater detail in FIGS. 2 and 6, the illustrated housing member 12 may be viewed as including a top wall or panel sub-unit (generally designated as 15), a bottom panel sub-unit (generally designated as 16) and vertically extending sidewall panel units which are generally referenced as 17. The sidewall panel unit 17 as depicted in the Figures may be further viewed as including a front sub-unit **17*a*, rear sub-unit 17*b* and side 17*c* panel sub-unit. The front 17*a*, rear 17*b*, top 15 and 16 bottom panel sub-units may be appropriately sewn together at an overlapping peripherial margin onto the left sidewall member 17*d* which in conjunction with the other side panel sub-units of unit 17 form a flexible external housing member 12 circumscribing or enveloping insulative liner 13. In the views, particularly depicted by FIGS. 1, 3 and 6, the front 17*a*, rear 17*b*, top 15 and bottom 16 sub-units may be fabricated from a single fabric cut sewn or seamed together onto another separate fabric cut which forms side panel unit portion 17*c*. A plastic or other suitable reinforcing edging material 12*b* serves to define the shape and configuration of the housing member 12** to reinforce its seams and place it in conformity with the tote bag configuration. If desired, separate pre-cut fabric pieces may be used to form the top, side and bottom panel units with the front and rear panel units obtained from mirror image patterns being sewn or joined together therewith to form the enclosing structure.

In one of the preferred embodiments of the illustrated invention, a portion of one of the uninsulated sections (such as left sidewall member **17*d*) serves in cooperative association with the remaining housing member 12 components to form the protective enshrouding enclosure for insulative liner 13. Alternatively, the housing member 12 may be fabricated as a separable cooling compartment 10 in which 17*d* is a separate sidewall sub-unit directly integrated into the housing member 12 structure and forming a separate sidewall apart from the uninsulated section. In such an alternative version, the self contained cooling compartment may be used, if desired, as a separable cooling compartment 10 which includes means (such as described later in greater detail) for securing it onto the tote bag. Although the housing member 12** is depicted as being of rectangular configuration, other suitable configuration thereof such as hemispherical, trapezoidal, etc. configurations may be used or substituted therefore. In the preferred embodiments of the invention as illustrated in the Figures, at least one of the housing member sidewall units will be in substantial conformance with the size and configuration of the uninsulated portion of the tote bag to which is attached.

The housing member 12 portion of the tote bag may be fabricated from a wide variety of synthetic or natural flexible materials such as currently used in the fabrication of conventional tote bags. Illustrative housing materials include durable fabrics such as heavy woven or meshed materials such as polyesters (e.g. RAYON), polyamides (e.g. NYLON), canvas, polyolefins (e.g. polypropylene), and the like. A 420 denier nylon oxford impregnated with a water-resistant coating (e.g. polyurethane) is particularly well suited for use in the fabrication of housing member 12. Although the woven, synthetic fabrics are preferred in the fabrication of external housing member 12; flexible and high impact films or sheets of thermoplastics molded or heat sealed in the appropriate shape and configuration may also be used for this purpose. If thermoplastic materials are used in the fabrication of the housing member 12, conventional thermoplastic techniques (e.g. adhesive bonding, heat sealing and/or forming, etc. with or without stitching) may also be used to fabricate the flexible housing member 12 and its attachment onto the uninsulated section A of the tote bag. The internal volumeric displacement within housing member 12 advantageously comprises a minor portion of the total internal or storage volume (including the uninsulated and insulated sections thereof) of tote bag 1. The housing member 12 is fitted with a housing member accessing port 18 (shown in FIG. 3 as being comprised of zippering tracks **18*a* and 18*b*, and track securing zipper 18*c*) secured to and extending from the upper portion of the front wall 17*a* across the top wall 15 and onto the upper portion of rear wall 17*b*. Housing member access port 18 when zipped opened accordingly affords access to liner 13**.

Figure 3:
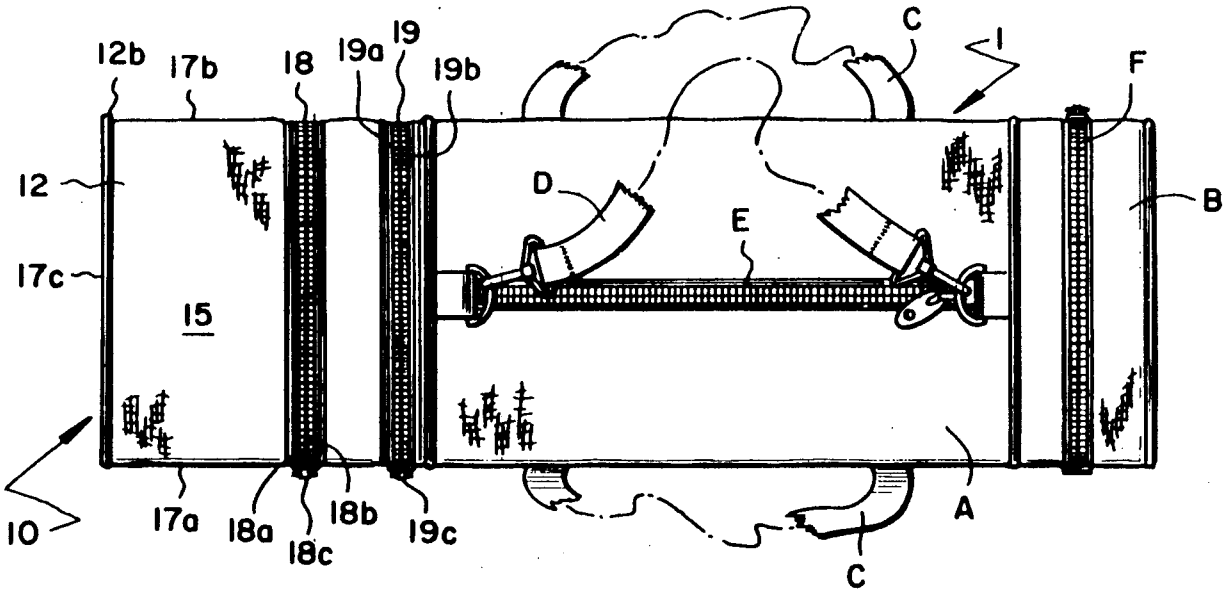
FIG. 3 is a top view of the tote bag shown in FIG. 1.

In the preferred embodiments of the invention as more specifically illustrated in FIGS. 1, 3 and 6, tote bag 1 is provided with means for detachably securing the cooling compartment 10 onto the tote bag 1 which means is generally designated as 19. Such means 19 may be accomplished by seaming zipper track 19b onto the cornering edges of left sidewall member 17d of uninsulated section A, a mating zipper track 19a onto the corresponding abutting margins thereto of the front 17a, rear 17b, bottom 16 and top 15 panel units and a zippering track fastener 19c thereof. This particular embodiment permits the extending portion of the housing member 12 (generally designated in FIG. 6 as 12a) to be simply attached when needed or removably detached from the uninsulated section A respectively by zipping or unzipping it from the tote bag. It may also be observed that the extending portion 12a substantially conforms to the shape and configuration of the left sidewall of the tote bag and forms an extension thereto which in turn contributes to its structural integrity and protective strength. Alternatively, button and button hole combinations, snap fasteners and the like may also be used to provide a readily detachable cooling compartment 10. Pursuant to this more limited embodiment of this invention, if the housing member 12 serves as a separate or self-contained cooling compartment 10 or if the extended housing member 12a includes its own right sidewall member (apart from 17d) which serves for attachment to the left sidewall sub-unit 17d, the insulated liner 13, external housing (complete or as an extended housing 12a), and the means 19 for attaching and detaching the cooling section 10 from a conventional tote bag may be fabricated and sold as a separate accessory for retro-fitting onto a conventional tote bag.

The flexible insulative liner 13 forms an enveloping insulative barrier for cooling chamber 11. The liner 13 must not only serve as an insulative barrier, but also must possess sufficient flexibility and strength to withstand the physical abuses which the tote bag typically encounters in its normal use. The insulative liner 13 thermally insulates and maintains the articles within chamber 11 at the desired thermal temperature. Although the insulated chamber 11 may be used to maintain articles over a broad thermal range (e.g. hot or heated foods to freezing temperatures), it is particularly adapted to serve as a refrigerating cooler such as for maintaining cooled articles within about 35° F. to about 55° F. temperature range. The liner 13 portion interfacing (i.e. inner surface) onto the cooling chamber 11 is advantageously of a substantially water-tight barrier construction and creates an impervious moisture barrier between the chamber 11 and the housing member 12. The inner liner 13 surface interfacing onto the cooling chamber 11 is also advantageously of a substantially smooth (flat or evenly contoured) surface construction. The liner 13 inner surface is also preferably substantially free from externally exposed communicating channels and pores conductive to either the transfer of moisture or gases (i.e. substantially impervious to gas or moisture) through liner 13 or into its interior. Such a design and construction provides a sanitary cooling chamber environment which may be effectively cleaned and sanitized so as to prevent the harboring of microbes and other undesirable contaminates (e.g. maladorous or deleterious biological or chemical substances, etc.) within the liner 13 and the cooling chamber 11. The ability to periodically clean and maintain the liner 13 in a sanitary and healthful condition effectively overcomes a particularly acute problem attendant to a tote bag fitted with cooling compartment 10.

A variety of flexible and pliable insulative materials may be used as a liner 13, including the open and/or closed cellular insulative material types. Open and closed cellular insulative products are distinguishable in that the open-celled insulative materials are generally comprise a multiplicity of void spaces (referred to as "cells") dispersed throughout a solid insulative matrix (typically of a low thermal conductance) in which the individual cells are interconnected therewithin by a labyrinth of intricate communicating passageways or channels therebetween. Illustrative of such flexible open-celled insulative materials include the open-celled foam polymeric materials (e.g. the foamed natural and synthetic rubbers, polyurethanes, polyesters, and the like), the synthetic and natural fibrous insulative materials such as felts (e.g. wool, wool/synthetic material combinations thereof, fiberglass), cottons (synthetic fibrous materials or thermoplastics) and the like. Fibrous materials of open-cell structure and particularly those which possess water absorbent or hydrophillic characteristics such as the felt (e.g. wool, wool synthetic fiber blends, etc.) will generally necessitate at least an inner water-proof barrier at the cooling chamber 11 and liner 13 interface to protect these liners from the deleterious effects (e.g. loss of insulative capacity, its destruction through mating, creation of maladorous and unsanitary liner conditions, etc.) of water absorption therewithin. Such open-celled insulative materials when used as a liner will also preferably include an external protective barrier cover or enclosure about or completely circumscribing an open-celled insulative material so as to protect it from external contamination. Flexible thermoplastic materials characterized as being substantially impervious to the transfer of moisture or water into the insulative material (e.g. polyvinyl chloride, polyethelene, polypropylene, polystyrenes, etc.) may be suitably adapted to serve as a protective covering or enclosure material therefore.

Certain open-celled fibrous materials of a flexible, durable and lightweight insulative construction (e.g. THINSULATE/GORTEX, etc.) are equipped with structurally integrated thermally insulative reflective films which render these materials breathable but yet water-proof. The texture, flexibility, tailoring and machinability attributes (e.g. ability to cut patterns, sew onto fabrics, etc.) of these insulative materials are similar to conventional fabrics. These cloth-type insulative materials have accordingly found use in the manufacture of insulative linings for wearing clothed apparel (e.g. shirts, overcoats, jackets, trousers, etc.) and footwear such as in removable insulative liner inserts for bootwear, etc. Such durable, breathable, lightweight, insulative efficacy, flexible and water-proof characteristics plus its compatability with the other components allow these cloth-type insulative materials to be used for certain applications as a liner 13 herein.

As mentioned, the surfaces of open-celled foamed polymeric materials (e.g. certain of the foamed rubbers, polyurethane, polyesters, sponges) characteristically possess a network of externally exposed pores and channels which communicate into and throughout the interior regions of the foam. As a general rule, many of the closed-celled polymeric materials will typically contain a smaller proportion (but yet a significant number) of externally exposed cells which communicate into the foam interior. Such internally communicating pores when placed in direct contact with the cooling chamber 11 can lead to unsanitary environmental conditions such as moisture and odorous material absorption as well serving to harbor microbes and other undesirable contaminates. An unsanitary environment can accordingly arise when such porous surfaced insulated materials are placed in direct contact to the cooling chamber 11. Fabrication and manufacturing techniques such as thermal melting of the foam surface and cooling of the surface under conditions to seal the porous surface structure, molding or calendering techniques to erradicate or close the surface pores, laminating a smooth thermoplastic sheet or film thereto, coating the surface with solvent dispersed or emulsified sealant, etc. may be effectively utilized to seal such porous surfaced materials and render such materials more suitable for use as an insulative liner 13 herein. The insulative material preferably consists essentially of a substantially closed-cell insulative liner 13 characterized or possessing sufficient resistance against the transfer or penetration of water into the insulative liner interior.

In the more limited embodiments of the invention, liner 13 consists essentially of thermoplastic film comprised of a plurality of gaseous cells individually encapsulated within a flexible matrix of a thermoplastic film. The strength, durability, cooling efficacy and sanitary attributes of these more limited liner 13 embodiments renders these materials particularly well suited for this invention.

In testing the efficacy of a number of various potential materials for liners, it has been observed that certain materials (not generally recognized for insulative efficacy) have an unexpected capacity to measurably reduce the cooling temperature within chamber 11. Included amongst this more limited class of materials are those materials characterized as having a multiplicity of substantially uniform gas cells encased or embedded within a thermoplastic sheet or film. It was further unexpectedly discovered that this more limited class of materials (which are not normally recognized or used as insulators in conventional portable coolers), especially under hot external environmental conditions, possess a greater capacity to significantly reduce the cooling chamber temperature, especially when compared to the conventional and art recognized insulative materials. Particularly well adapted for this purpose (as depicted in FIGS. 2, 4, 5 and 6), are those liners which consist essentially of a flexible, water-proof, thermoplastic film or sheet having embedded therewithin a plurality of uniformily positioned, closed gaseous air cells 13A (shown as projecting outwardly from the film surface in FIG. 5) of a sufficient size and uniform distribution throughout the film so as to impart an insulative barrier between housing member 12 and chamber 11. Comparative to the more conventional insulative materials, insulative liner 13 of such a construction contributes to an internal cooling chamber temperature reduction by a factor of 3°-5° C. or more.

Figure 5:
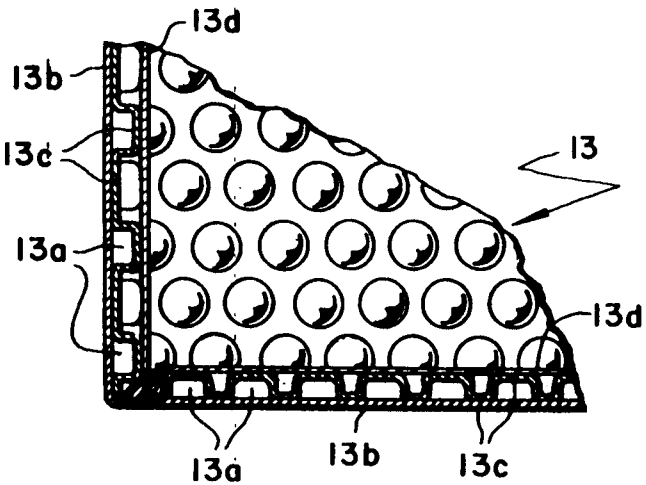
FIG. 5 shows a cross-sectional view of the insulative liner taken along line 5—5 of FIG. 4.

A fuller appreciation of this more limited aspect of the invention may be found by referring in particular to FIG. 5. Within the packaging and shipping industry, materials characterized as containing entrapped air between laminated sheets or films have heretofore been extensively used to protect fragile or breakable articles from damage during shipping and the warehousing thereof. As specifically illustrated in FIG. 5, one of the laminated films (referenced as 13C) possesses a contoured surface from which a plurality of hemispherical or domed-shaped rows of the encased gas-containing cells 13A projecting outwardly therefrom while the other laminated film component 13B thereof provides an internal and external surface which is substantially flat. As specifically illustrated in FIG. 5 such commercially available packaging materials are typically fabricated in such a manner so that the gas containing cells are symmetrically arranged in rows with each adjacent row of gas containing cells being positioned therewithin in an off-set manner while the alternating rows (within the patterned sequence) having gas cells resting in substantially horizontal and vertical alignment to one another. This creates a pattern of alternate rows bearing a vertical and horizontal alignment of dome-shaped cells 13A and an overall pattern of diagonal alignment of gas containing cell rows therewithin. Advantageously, the dome-shaped cells are circular in shape and of a cross-sectional diameter of about 5 mm or more (e.g. 5-25 mm) in width. These dome-shaped cells will advantageously measure at least 1 mm in height (e.g. 2 to about 10 mm) and preferably about 3 mm or more (e.g. 3 to about 7 mm) in height. An insulative liner fabricated from a commercially available material characterized as being crafted from thousands of tough, puncture-resistant air cells encased in polymeric LLDPE of an opaque or heat absorbent pigmentation (e.g. blue, purple, black) such as a SOLAR-CELL SUNBLANKET TM, manufactured and distributed by Century Products, Inc., 171 Medford Street, Maiden, Mass. 02148 has been found to unexpectedly contribute towards significantly lowering the cooling chamber temperature while also imparting exceptional strength and protective features to the tote bag.

In one of the preferred embodiments of this invention, a flat plastic sheet or film (referenced as 13D in FIGS. 2 and 5) of a heat absorbent color is secured to the contoured film 13C surface so as to rest flushly onto the top or apex of the dome-shaped projections 13A and thereby provide a smooth contoured covering surface therefore wherein the confined air space between films 13D and 13C further contributes an added insulative factor to the insulative liner 13. Other variations for involving entrapping insulative gases (e.g. air, carbon dioxide, etc.) within a single or plurality of chambers which are substantially impervious to the transfer or escape of the entrapped gases therefrom may also be used as an insulative liner barrier. If the insulative liner 13 as depicted in FIGS. 2 and 5 is utilized without the film 13D embodiments, the dome-shaped cell 13A projections are advantageously faced inwardly towards chamber 11 with the flat film 13B surface thereof interfacing onto the housing member 12 inner surface.

In another embodiment not specifically illustrated, the insulative efficacy, protection against contamination and durability prerequisites thereof, may be further enhanced by partially or completely overlapping and interfacing the domed projections onto one another and fastening or sealing (e.g. heat sealing, plastic cement, seaming, fastening combinations, such as VELCRO, etc.) the overlaps together. The two external surfaces thus formed (i.e. the surfaces respectively interfacing onto the housing member and inner chamber) are substantially flat in contour with additional insulative efficacy being further achieved by the double layered effect of the gas containing films, plus the added insulative air space between the overlapped films. Irrespective of whether a single or film of encased gaseous cells or an additional film sheet overlap is used as liner 13, a highly durable, protective and highly effective insulative barrier will be achieved. The overlapped structure, however, will further enhance protection against damage to contents housed within the cooling chamber while also enhancing its insulative efficacy.

The insulative liner 13 will advantageously possess sufficient thermal insulative capacity to maintain (at an external temperature maintained at 27° C.) cooling chamber 11 at a temperature of less than 20° C. for at least four hours (advantageously for at least 5 hours and preferably more than 6 hours) when loaded with a charge of 16.5 grams of frozen ice for each liter of cooler chamber volume. In the preferred embodiments of the invention, the cooling chamber temperature will be maintained by the insulative liner 13 at about 15° C. or less when charged with 16.5 grams of ice for each liter of cooling chamber capacity (at an external temperature of 27° C.) for a period of at least 2 hours, advantageously for at least 3 hours, preferably for at least 4 hours, and most preferably for at least 5 hours. In general, the liner will measure at least 0.1" thick and typically less than about one inch in thickness. For most applications, the liner will advantageously comprise a flexible insulative liner measuring from about ¼" to about ¾" thickness, and preferrably from about ⅜ to about ½ inch thickness.

Figure 4:
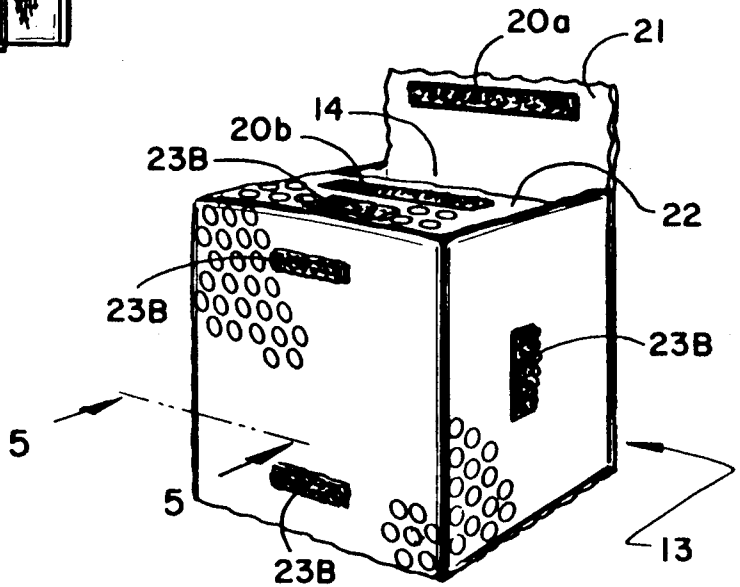
FIG. 4 is an external view of an insulative liner removed from cooling compartment.

The liner 13 (as illustrated in FIGS. 2 and 4) preferably includes an insulated liner access port (generally designated as 14) equipped with an enclosure fastening means (generally designated as 20) which when fastened forms an insulated enclosure about the access port 14 and when unfastened affords access to the cooling chamber 11. This may be effectively accomplished as illustrated in FIGS. 2 and 4 by interfacially overlapping the periphery margin portion 21 bordering access port 14 of liner 13 onto the interfacially overlapped liner portion 22 and fitting the overlapped liner portions 21 and 22 with a fastening means 20 for securing the liner overlaps together and forming an insulative seal therebetween as depicted in FIG. 2. A variety of fastening means (e.g. draw strings, snap fasteners such as metal or plastic fasteners of a knobbed or hooked male projections with mating female orifices or loops, hooked fasteners, buckles, etc.) may be used for this purpose. A particularly well-suited fastening or securing means 20 embodies fitting the overlapping liner margins (21 and 22) with a hook and napped loop fastener combination (e.g. VELCRO of VELCRO U.S.A., Inc.) such as disclosed in U.S. Pat. Nos. 2,717,437; 3,000,384; and 3,009,235. As illustrated in FIGS. 2, 4 and 6, the hooked tape portion thereof (depicted as 20A comprised of a multitude of plastic hook projections) may be affixed along the overlapping liner flap 21 and the plastic looped tape or napped strip 20B (comprising a multitude of looped plastic projections) may be attached onto the interfacing liner portion 22 so as to correspondently register therewith. Upon firmly pressing together the hooked strip 20A against the napped or looped plastic strip 20B, the fastening combination will become securely and firmly bound together until manually released. This particular combination affords a means for insulatively sealing the liner 13 together at the access port 14. The fastener combination (20) may easily be released for access into the cooling chamber simply by pulling fastener strip 20A away from the fastener strip 20B. These fastener combinations are commercially available in a tape form wherein the reverse tape surfaces from the napped or hooked projection includes a pressure sensitive cement adhesives for adhesively securing and bonding the respective fastening tapes onto the corresponding insulative liner portions 21 and 22.

Due to the nature of the articles transported and the conditions to which they are exposed, tote bags are inherently susceptible to creating environmental conditions highly conductive to the harboring and culturing of microbial infestation. The cooling compartment should accordingly be of a design and construction to maintain satisfactory sanitary conditions for its intended use. In the preferred embodiments of the invention as illustrated by the Figures, liner 13 includes means for its removal from housing member 12. The tote bag as illustrated by the Figures, affords two means whereby the liner 13 may be separately removed from the housing member. This may be accomplished by removing liner 13 through the housing member access port 18 or by detaching the housing member 12A via the means for securing it 19 to the uninsulated portion A of the tote bag as illustrated in FIG. 6. This former embodiment permits liner 13 to be removed for periodic cleaning while also permitting the cooling compartment 10 with the removed liner 13 to be utilized as a conventional luggage compartment.

Pursuant to a more limited embodiment of the invention (as more specifically depicted in FIGS. 2, 4 and 6) the insulative liner 13 also includes means for detachably securing liner 13 to housing member 12, which detachable securing means is generally referenced in the Figures (namely FIGS. 2, 4 and 6) as 23. The liner 13 s shown in FIG. 4 will possess sufficient structural integrity to retain its configuration (in the absence of impact) and prevent its collapse within the housing member 12. However, as previously pointed out, tote bags are often exposed to abuses which can lead to deformation or collapse (especially in the partially filled state) of the housing member 12 and liner 13. To further maintain the structural integrity of liner 13 it is thus advantageous to include a detachable securing means 23 for attaching and removing liner 13 to the top inner panel unit 15 and also preferably onto the inner wall of side panel **17*c* of housing member 12. The removable liner 13 is most preferably interfacially secured onto sidewalls (e.g. 17*a*, 17*b*, 17*c* and 17*d*) of the housing member 12, the top panel unit 15 and most preferably also onto bottom panel unit 16 so that liner 13 and cooling chamber 11 will substantially be maintained in conformance with the inner contoured configuration of the housing member 12. The means (generally prefixed, in the illustrations as depicted in the drawings by the number 23) for interfacially securing the liner to the housing member preferably comprises the fastener combination used to seal the access port 14 together as described above. In this preferred embodiment, the interfacing surfaces of the liner 13 and the housing member 12 are provided with mating fasteners which secure liner 13 against the housing member 12. This may be accomplished by positioning the interfacing mating fasteners (23A and 23B) along the outer peripherial margins of liner 13 (e.g. lateral to access port 14) and top panel unit 15 and preferably at least one fastener combination 23B at each of the corresponding interfacing liner surfaces and the other fastener combination 23A onto the corresponding surfaces of sidewalls 17*a*, 17*b*, 17*c* and 17*d* of housing member 12. This is shown in part by referring to FIGS. 2, 4 and 6, wherein there is shown affixed to the inner surface of the housing member a plurality of strips of a fastening combination (generally depicted as 23A and 23B), such as strip 23A to top panel 15, left sidewall member 17D, front 17*a*, rear 17*b*, side 17*c* of housing member 12 with the mating fastener strip combination thereto 23B being correspondingly affixed onto the external surface of liner 13** for mating registration thereto.

The preferred means (prefixed by 23) of providing a detachable insulative liner affords a plurality of beneficial advantages. It will also be observed that strips 23A and 23B in effect also serve as spacers between the housing member 12 and liner 13 as illustrated in FIGS. 2 and 6. Since housing member 12 is typically fabricated from "breathable fabrics" partially previous to the transfer of gases including moisture, the liner 13 becomes properly vented for the transfer and removal of surface condensate (e.g. water) therefrom. This will help to maintain the external components of the cooling compartment 10 in a dry condition and thereby inhibit microbial infestation while also exerting an ancilliary cooling effect via the evaporation of any water accumulation therefrom. An additional benefit derived by the spacing of liner 13 apart from housing member 12 arises by the added protection the air space also contributes towards protecting the liner 13 from potential damage. The detachable securing means 23 for liner 13 is particularly important not only for the gas containing film insulative liner embodiments, but also an important factor if an insulative liner 13 of a substantially lesser structural strength is used. The detachable securing means 23 contributes substantial protection to the liner 13 as well as enhancing its insulative efficacy.

What is claimed is:

1. A durable tote bag comprised of an uninsulated luggage compartment and a cooling compartment, with said cooling compartment comprising a flexible housing member secured onto and extending outwardly from said uninsulated compartment, a cooling chamber contained within said housing member, a flexible insulative liner enveloping said chamber and disposed between said member and said cooling chamber, an accessing port within said member and said liner so as to provide access to the cooling chamber means for detachably removing said liner from said cooling compartment, and means for securely attaching the cooling compartment onto the uninsulated compartment and removing the cooling compartment therefrom.

2. The tote bag according to claim 1 wherein the insulative liner consists essentially of a flexible thermoplastic film having entrapped therewithin a plurality of closed gaseous cells of a sufficient size and uniform distribution so as to impart an insulative barrier between said housing member and said chamber.

3. The tote bag according to claim 2 wherein the insulative liner accessing port is formed by the overlapping of a portion of the film onto another overlapped portion of the film.

4. The tote bag according to claim 3 wherein the overlapping portion of the liner includes a pressure sensitive fastening combination which upon the application of pressure fastens the combination together and forms an insulative seal therebetween, and upon the application of a sufficient force to pull the fastening combination apart affords access to the cooling compartment.

5. The tote bag according to claim 1 wherein the liner comprises a flexible film characterized as containing a plurality of macroscopic gaseous cells uniformly aligned and entrapped in a plurality of rows within said film.

6. The tote bag according to claim 5 wherein the insulative liner is characterized as being sufficient to maintain the cooling chamber at a temperature of less than about 15° C. for at least 3 hours when the cooling chamber is charged with 16.5 grams of ice for each liter of cooling capacity of said cooling chamber.

7. The tote bag according to claim 5 wherein the macroscopic cells have a cross-sectional diameter ranging from about 10 mm to about 15 mm and a height ranging from about 3 mm to about 7 mm.

8. The tote bag according to claim 1 wherein the flexible film includes within its construction a heat absorbent pigmentation.

9. The tote bag according to claim 1 wherein the means for attaching and removing the cooling compartment from the uninsulated compartment comprises a zipper fastener combination which secures the housing member onto the uninsulated compartment.

10. The tote bag according to claim 1 wherein the housing member accessing port is of a sufficient size to permit the insulative liner to be removed from the housing member.

11. The tote bag according to claim 1 wherein a sidewall portion of the uninsulated luggage compartment interfacing onto the insulative liner in combination with a portion of the housing member secured thereto and extending outwardly therefrom forms the flexible housing member for housing said insulative liner therewithin.

12. The tote bag according to claim 11 wherein the insulative liner consists essentially of thermoplastic film characterized as containing a plurality of individually encapsulated macroscopically sized gas cells uniformily distributed throughout the film in a substantial plurality of uniformily arranged and aligned rows of gas cells therewithin.

13. The tote bag according to claim 1 wherein said means for detachably removing includes a portion of the housing member interfacing onto the insulative liner and a portion of the insulative liner interfacing thereto being fitted with a pressure sensitive fastening combination which upon fitting together under pressure, will form a fastening bond therebetween and upon the application of a sufficient force to pull apart the fastening combination will release the fastening bond therebetween, with the portion of the housing member and the portion of insulative liner being fitted with said fastening combination being positioned at a sufficient number of interfacing sites therebetween to retain the liner in substantial conformance to the internal configuration of said housing member.

14. A detachable and attachable cooling compartment accessory for attachment onto an uninsulated compartment of a tote bag, said accessory comprising:

(a) a flexible housing member for attachment onto the uninsulated compartment so as to provide an outwardly extending extension thereto;

(b) a cooling chamber within said housing member;

(c) a removable, flexible insulative liner enveloping said chamber and disposed between said member and said cooling chamber with means for detachably removing said liner from said member;

(d) an accessing port within said member and said liner so as to provide access to the cooling chamber thereby; and (e) means for securely attaching said housing member onto the uninsulated compartment and detaching said member therefrom.

15. The accessory according to claim 14 wherein the insulative liner consists essentially of a flexible thermoplastic film having entrapped therewithin a plurality of projecting closed gaseous cells of a sufficient size and uniform distribution so as to impart an insulative barrier between said housing member and said chamber.

16. The tote bag according to claim 15 wherein the flexible film is characterized as containing a plurality of macroscopic gaseous cells uniformily aligned and entrapped in a plurality of rows within said film.

17. The accessory according to claim 16 wherein the means for attaching and detaching the cooling compartment from the tote bag comprises a zipper fastener combination which secures the housing member onto an uninsulated compartment of the tote bag.

18. The accessory according to claim 17 wherein the housing member accessing port is of a sufficient size to permit the insulative liner to be removed from the housing member.

19. The accessory according to claim 18 wherein the insulative liner accessing port is formed by the overlapping of a portion of the film onto another overlapped portion of the film.

* * * * *